US006467999B2

(12) United States Patent
Muramatsu et al.

(10) Patent No.: US 6,467,999 B2
(45) Date of Patent: Oct. 22, 2002

(54) INTERNAL PRESSURE REGULATING SYSTEM FOR FLEXIBLE BAG BODY, FLEXIBLE MEMBRANE DAM USING THE SAME, AND METHOD FOR REGULATING INTERNAL PRESSURE IN THE FLEXIBLE MEMBRANE DAM

(75) Inventors: Tateo Muramatsu, Yokohama; Satoshi Tagomori, Chigasaki; Masaru Kaneko, Yokohama, all of (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/814,805

(22) Filed: Mar. 23, 2001

(65) Prior Publication Data

US 2001/0028826 A1 Oct. 11, 2001

(30) Foreign Application Priority Data

Mar. 28, 2000 (JP) ..... 2000-087899

(51) Int. Cl.[7] ..... E02B 3/10

(52) U.S. Cl. ..... 405/107; 405/91; 405/114; 405/115; 52/2.11

(58) Field of Search ..... 405/40, 32, 68, 405/91, 92, 107, 110, 114, 115; 52/2.11, 2.16, 2.17, 2.22

(56) References Cited

U.S. PATENT DOCUMENTS

| | | | | | |
|---|---|---|---|---|---|
| 1,421,857 | A | * | 7/1922 | Store | 405/107 X |
| 3,173,269 | A | * | 3/1965 | Imbertson | 405/115 X |
| 3,855,800 | A | * | 12/1974 | Ganzinotti | 405/91 |
| 4,330,224 | A | * | 5/1982 | Muramatsu et al. | 405/115 |
| 4,498,810 | A | * | 2/1985 | Muramatsu et al. | 405/115 |
| 4,909,666 | A | * | 3/1990 | Takasaki | 405/115 |
| 5,127,766 | A | | 7/1992 | Matsuoka et al. | |
| 5,186,391 | A | * | 2/1993 | Roueche et al. | 239/373 |
| 5,230,585 | A | * | 7/1993 | Fujisawa et al. | 405/115 |
| 6,102,620 | A | * | 8/2000 | Muramatsu | 405/115 |
| 6,250,977 | B1 | * | 6/2001 | Ness | 440/38 |

FOREIGN PATENT DOCUMENTS

| | | | | |
|---|---|---|---|---|
| DE | 3934530 | * | 4/1991 | 405/115 |
| JP | 57155415 | * | 9/1982 | 405/91 |
| JP | 57190816 | * | 11/1982 | 405/115 |
| JP | 60030710 | * | 2/1985 | 405/115 |
| JP | 60062314 | * | 4/1985 | 405/107 |
| JP | 61049014 | * | 3/1986 | 405/107 |
| JP | 61169512 | * | 7/1986 | 405/115 |
| JP | 63089713 | * | 4/1988 | 405/107 |

* cited by examiner

*Primary Examiner*—Heather Shackelford
*Assistant Examiner*—Jong-Suk Lee
(74) *Attorney, Agent, or Firm*—Oliff & Berridge, PLC

(57) ABSTRACT

There is provided an internal pressure regulating system in which when a flexible bag body used for a collapsible dam is excessively pressurized, gas within the bag body is discharged. The system includes a flexible bag body which can be inflated with gas, and a pipe having opposite ends, with one end connected to an exhaust opening in the bag body, and the other end introduced into the upstream region of a watercourse.

26 Claims, 4 Drawing Sheets

INTERNAL PRESSURE REGULATING SYSTEM FOR FLEXIBLE BAG BODY, FLEXIBLE MEMBRANE DAM USING THE SAME, AND METHOD FOR REGULATING INTERNAL PRESSURE IN THE FLEXIBLE MEMBRANE DAM

BACKGROUND OF THE INVENTION

1. Field of the Invention

The present invention relates to an internal pressure regulating system for a flexible bag body used for an inflatable and collapsible dam, particularly, to an internal pressure regulating system for a flexible bag body, in which an internal pressure of a flexible bag body can be automatically regulated, by a simple structure, in accordance with a level of a water area in which the flexible bag body is provided. The present invention also relates to a flexible membrane dam using the above-described system, and a method for regulating an internal pressure of the flexible membrane dam.

2. Description of the Related Art

Conventionally, a flexible membrane dam/weir has been widely used, wherein a flexible bag body is inflated by supplying air therein and is deflated by discharging air therefrom. Such a flexible membrane dam is structured in such a manner that a flexible bag body having a heightwise dimension corresponding to an operating condition is in advance prepared, and placed on the ground near a watercourse such as a river to form a collapsible dam.

There are cases in which due to an abnormal condition of an air supplying device or due to exposure to sunlight in a state in which the flexible bag body is inflated when a water area in which the flexible bag body is provided, has a low level, an internal pressure of the flexible bag body may excessively increase so that a tension exceeding an operating standard would act on the flexible bag body. Accordingly, heretofore, there have been used internal pressure regulating systems using a water sealing pipe, a U-tube, or a back pressure regulating valve.

FIGS. 4A and 4B show such conventional internal pressure regulating systems as described above. FIG. 4A is a cross sectional view when a water sealing pipe is used, and FIG. 4B is a cross sectional view when a U-tube is used. The water sealing pipe is structured in such a manner that an open end 12 of a branch pipe 11 into which gas within a flexible bag body (not shown) is introduced, is submerged in the water 13. When the internal pressure of the flexible bag body becomes a water head pressure or higher, gas within the flexible bag body pushes out water within the branch pipe 11 and leaks out so that the internal pressure of the flexible bag body decreases.

An internal pressure regulating system using a U-tube is structured in such a manner that water 15 is stored in a U-tube 14 into which gas within the flexible bag body is introduced, and when an internal pressure of the bag body increases, gas within the bag body pushes up the water 15 within the U-tube 14 so as to regulate the internal pressure and a water head pressure. Accordingly, the capacity of the flexible bag body increases by an amount of water pushed up, and the internal pressure decreases. Further, a back pressure regulating valve is provided in the flexible bag body, and when the internal pressure becomes a predetermined value or higher, the valve is brought into an open state.

However, in the internal pressure regulating systems using a water sealing pipe or a U-tube, suitable supply of water into the pipe is required and a special piping structure becomes necessary. Further, such internal pressure regulating systems using a water sealing pipe, a U-tube, or a back pressure regulating valve as described above are not necessarily sufficient ones in the structural and operational aspects, and each have a problem in that the internal pressure of the flexible bag body cannot be regulated in accordance with a level of a water area in which the flexible bag body is provided.

SUMMARY OF THE INVENTION

In view of the aforementioned, it is one object of the present invention to improve conventional internal pressure regulating systems to provide an internal pressure regulating system for a flexible bag body, which makes it possible not only to prevent an internal pressure of the flexible bag body from excessively increasing, but also to regulate, by a simple structure, the internal pressure in accordance with a level of a water area in which the flexible bag body is provided. Further, it is another object of the present invention to provide a flexible membrane dam which has a predetermined heightwise dimension by regulating an internal pressure thereof and which is deflated by a proper overflow, and a method for regulating an internal pressure of the flexible membrane dam.

The present invention has been devised in order to achieve the above-described objects. A first aspect of the present invention is an internal pressure regulating system for a flexible bag body, in which gas within a flexible bag body is discharged when the flexible bag body used for a collapsible dam is excessively pressurized, the system comprising a flexible bag body which can be inflated with a gas for damming the body of water into upstream and downstream regions, and a pipe body having opposite first and second ends, wherein the bag body includes an exhaust opening for exhausting the gas, the first end of the pipe body is connected to the exhaust opening in the bag body, and the second end of the pipe body is introduced into the upstream region of the body of water. Namely, due to utilization of the pressure of the water at the upstream side, the internal pressure of the bag body can be automatically adjusted so as to correspond to the upstream water level.

Preferably, an internal pressure regulating system for a flexible bag body is provided in which at least one non-return valve is provided in the pipe body to prevent water from flowing from the upstream side into the bag body.

More preferably, the open end of the pipe body is submerged in water, from the surface of the water at the upstream side of the water area in which the flexible bag body is placed, at a position which is lower than or equal to a reference level at which the flexible bag body is installed. The exhaust opening of the bag body is provided at a position separated from an air supplying opening at which gas from an air supplying device is supplied into the bag body, particularly, the exhaust opening is provided at one end of the bag body. The air supplying opening is provided at the other end of the bag body. Further, the exhaust opening is provided at an upper side of a level of drain within the bag body. Drain is produced by the condensation of the water content contained in the gas supplied into the bag body and a level of drain is an amount of drain collected at the base of the bag body.

A second aspect of the present invention is a flexible membrane dam including the above-described internal pressure regulating system, in which the flexible bag body can be inflated by supplying gas therein and can be deflated by discharging gas therefrom.

A third aspect of the present invention is a method for regulating an internal pressure in a flexible membrane dam, which includes continuously or intermittently supplying gas into a flexible bag body.

According to the internal pressure regulating system of the present invention, the internal pressure of the bag body is automatically adjusted so as to correspond to the upstream water level. That is, when an internal pressure higher than or equal to the upstream water level is generated in the bag body, air is blown off from the internal pressure regulating system. Further, in an overflow state, the internal pressure is adjusted so as to correspond to an overflow level. In a non-overflow state, air pressure is adjusted to become an internal pressure corresponding to the upstream water level, and excessive increase in the pressure caused by exposure to sunlight or the like is prevented. As described above, in the present invention, a mechanical structure in which the internal pressure can be safely adjusted in accordance with the upstream water level, is provided without using an electrical structure which may cause a failure.

DESCRIPTION OF THE PREFERRED EMBODIMENTS

Figure 1:
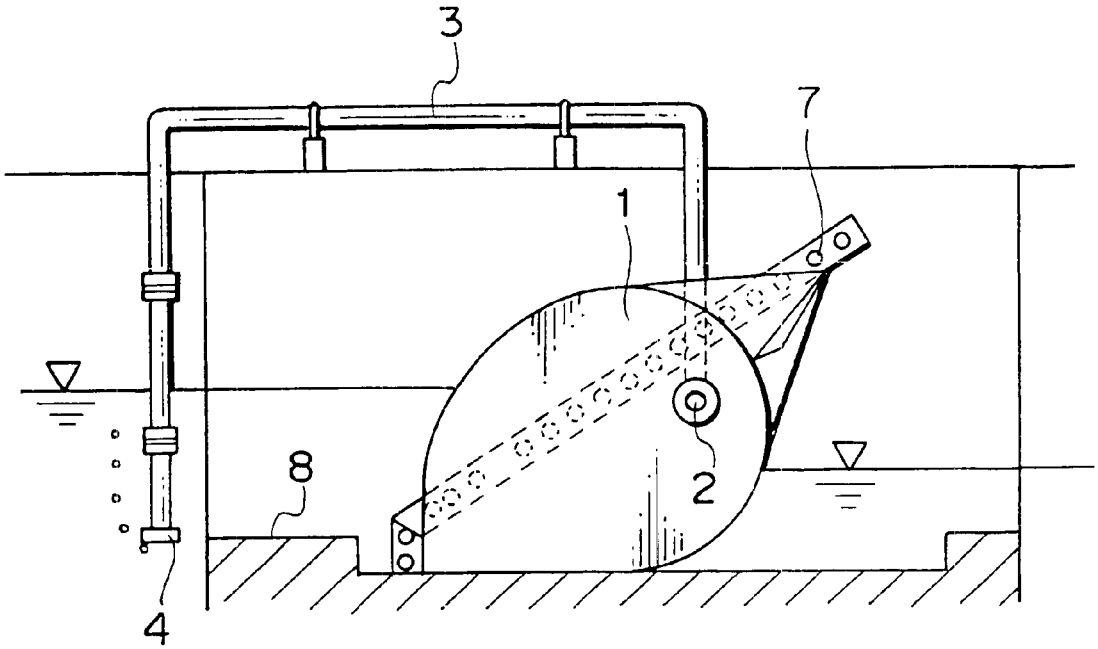
FIG. 1 is a cross sectional view which shows a flexible membrane dam using an internal pressure regulating system according to a first embodiment of the present invention.

An internal pressure regulating system for a flexible bag body according to the present invention is comprised of a flexible bag body in which gas can be filled, and a pipe body extending from an exhaust opening formed in the bag body and having an open end. The bag body may have any structure which allows filling of gas therein and which is able to resist fluid pressure of a river or the like. The most preferable embodiment of the bag body is a structure in which an air chamber is formed by providing a non-bonded layer within a plate-like rubber reinforced by nylon fiber. When gas is discharged, the structure is made into a plate-like configuration.

Further, the open end of the pipe body is introduced into the water at an upstream side of a water area in which the flexible bag body is provided. Usually, gas filled in the flexible bag body is sealed by water flowing into the open end. The amount of water flowing from the open end varies depending on a water level at the upstream side of the water area in which the flexible bag body is provided. That is, in the internal pressure regulating system of the present invention, when it is necessary to increase the internal pressure for the reason that the water level at the upstream side rises so that a fluid pressure acting on the flexible bag body increases, a hydraulic pressure at the side of the open end also increases accompanied with rising of the water level. Therefore, the internal pressure and the hydraulic pressure are constantly balanced.

As described above, the internal pressure regulating system of the present invention utilizes the hydraulic pressure at the upstream side of the water area in which the flexible bag body is provided. Therefore, the internal pressure of the bag body varies in accordance with the water level at the upstream side so that a proper internal pressure can constantly be set automatically. As a result, it is not necessary that an exhaust pressure setting device of internal gas be additionally provided. Only when the internal pressure of the bag body excessively increases, blow-off of gas from the open end of the pipe body occurs.

Further, when the water level at the upstream side greatly becomes higher, or the like, there is a fear of a state in which water counter-flows in the pipe body and intrudes into the flexible bag body. Accordingly, a non-return valve may be provided in the pipe body for a case in which the level of the water area in which the flexible bag body is placed, may vary.

A method for introducing the open end of the pipe body into the water is not particularly limited as long as the open end of the pipe body is introduced at the upstream side of the water area in which the flexible bag body is placed. The pipe body may be introduced from the bottom of the water or from the surface of the water. In the most preferable embodiment, the open end of the pipe body is submerged from the surface of the water. A degree at which the pipe body is sunk under water, is set so that the open end is located at the same level as a reference level at which the flexible bag body is placed, or lower. As a result, the internal pressure of the bag body becomes zero when the water level at the upstream side decreases to the reference level at which the flexible bag body is placed, and the bag body can be automatically collapsed. When the pipe body is introduced from the bottom of the water and the open end thereof is located on the bottom of the surface, drain within the bag body can be discharged simultaneously.

Generally, an air supplying device is connected to the flexible bag body and air is supplied from an air supplying opening into the bag body. Accordingly, at the time of air supply, the internal pressure in the vicinity of the air supplying opening becomes higher, and pressure distribution of the bag body is not necessarily uniform. Further, it is also necessary to prevent drain from coming into the pipe body. Accordingly, a structure is most preferable in which an exhaust opening of the bag body is provided at a position separated from the air supplying opening and above the drain in the bag body, particularly, at an upper side of one end of the bag body, and the air supplying opening is provided at the other end of the bag body.

The above-described internal pressure regulating system is used for a flexible membrane dam which can be inflated by supplying gas therein and can be deflated by discharging gas therefrom. Namely, it is necessary that the flexible membrane dam has a predetermined heightwise dimension and is laid flat by a proper overflow. For this reason, excessive increase in the pressure of the flexible bag body used for the flexible membrane dam should be prevented. Accordingly, excessive increase in the pressure, which is caused by an abnormal condition of an air supplying device or exposure to sunlight in a state in which the bag body is erected when the water level is low, is controlled by the internal pressure regulating system.

The internal pressure of the flexible membrane dam is automatically adjusted so as to basically correspond to an upstream water level. That is, when the internal pressure in the flexible bag body relatively increases due to increase in the internal pressure caused by an abnormal condition of an air supplying device or exposure to sunlight, or decrease in the upstream water level, gas within the bag body blows off via the pipe body until the internal pressure in the bag body is balanced with a pressure corresponding to the upstream water level. Further, in an overflow state, the internal pressure is adjusted so as to correspond to the overflow level. Accordingly, the flexible membrane dam is maintained with a predetermined heightwise dimension and can be used safely and continuously.

It may also be considered that after the upstream water level and the internal pressure of the flexible bag body have been balanced, the internal pressure of the flexible bag body relatively becomes low due to a raised upstream water level, a drop in atmospheric temperature, or the like. In this case, usually, balance is kept due to decrease in the capacity of the bag body, which is caused by the water coming into the pipe body. However, there is a possibility that the internal pressure of the flexible bag body may greatly decrease. Accordingly, in the most preferable embodiment, an air supplying device equipped with a timer is adapted to intermittently supply air in such a manner as to operate for five minutes at intervals of 24 hours. So long as air is intermittently supplied, when the internal pressure in the flexible bag body is relatively high, gas within the bag body blows off via the pipe body. Further, when the internal pressure of the flexible bag body is relatively low, it increases to a balanced pressure intensity. Thus, a necessary amount of air is constantly maintained.

A small-size blower (for example, an engine type or solar-cell type blower of 0.3 kw or thereabouts) may be provided separately from the air supplying device so as to constantly supply air. Further, when installation of the timer, or provision of the small-size blower is now allowed, the air supplying device can be manually operated when necessary.

A description will be given of embodiments of the present invention with reference to the attached drawings.

FIG. 1 is a cross sectional view showing a flexible membrane dam according to a first embodiment which is the above-described most preferable embodiment of the present invention. As shown in FIG. 1, the flexible membrane dam is provided in such a manner that a flexible bag body 1 into which gas can be filled, can be inflated by supplying gas therein and can be deflated by discharging gas therefrom. Further, the heightwise dimension of the dam is determined by adjusting a state in which the bag body is inflated, based on an amount of gas supplied into the bag body 1 (that is, the internal pressure of the bag body 1).

The flexible bag body 1 has a structure in which an air chamber is formed by providing a non-bonded layer within a plate-like rubber reinforced by nylon fiber. When gas is discharged from the bag body, the structure is made into a plate-like configuration. An exhaust opening 2 is formed in the bag body 1, and a pipe body 3 (50A) having an open end 4 extends from the exhaust opening 2. The exhaust opening 2 is provided at the upper side of an end of the bag body 1 at a side opposite to the side at which an air supplying opening for supplying gas from an air supplying device (not shown) into the bag body 1, is provided.

Figure 2A:
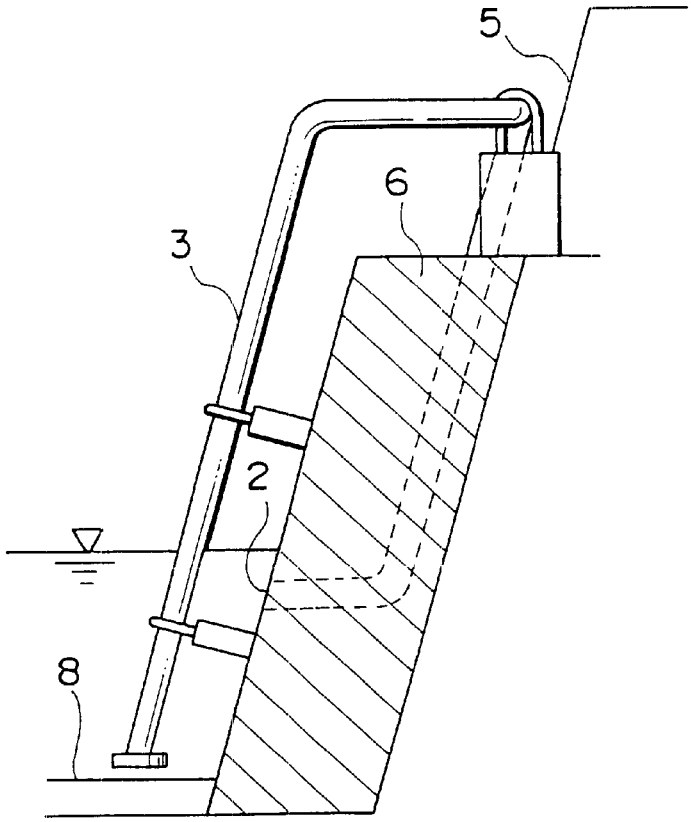
FIGS. 2A and 2B are diagrams each showing a state in which a pipe body of the internal pressure regulating system of the present invention is installed.
Figure 2B:
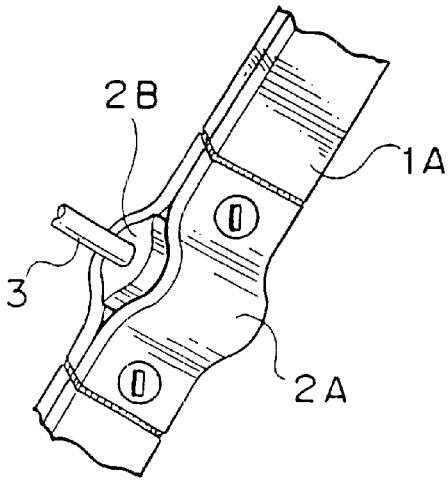

A method for installation of the pipe body 3 is shown in FIGS. 2A and 2B. As shown in FIG. 2A, the pipe body 3 is disposed from a portion in which the exhaust opening 2 is formed, over a slope-face toward a crest by placing concrete to a surface 5 to which arrangement of bar is exposed. After installation of the pipe body 3, pulling support members are fixed by round steel or the like using arrangement of bar, and a concrete application portion is covered with concrete (a concrete portion 6). When the pipe body 3 and an anchor bolt 7 contact each other, the anchor bolt 7 is cut off, and a cutting portion of the anchor bolt 7 and the arrangement of bar are welded and fixed together using round steel or the like.

Further, as shown in an enlarged view of FIG. 2B, a pair of metal fittings 2A each having a substantially semicircular configuration, are formed by being mounted at a portion of a mounting metal fitting 1A of the bag body. A substantially diamond-shaped rubber member 25 with the pipe body 3 passing therethrough is interposed between the metal fittings 2A.

The pipe body 3 extending toward the upstream side, extends along the slope face to the same level as a reference surface 8 at which a dam is installed. As shown in FIGS. 1 and 2, the open end 4 of the pipe body 3 is submerged from the surface of the water at the upstream side of the water area in which the flexible bag body is placed, and is located at a position which is the same level as the reference surface 8 at which the flexible bag body 1 is installed, or lower. The pipe body 3 may be a rubber hose in a state of emergency.

Accordingly, when the internal pressure of the flexible bag body 1 relatively becomes higher due to increase in the internal pressure, which is caused by an abnormal condition of an air supplying device or exposure to sunlight, or decrease in the upstream water level, gas within the bag body blows off via the pipe body 3 until the internal pressure becomes balanced with a pressure corresponding to the upstream water level.

Figure 3:
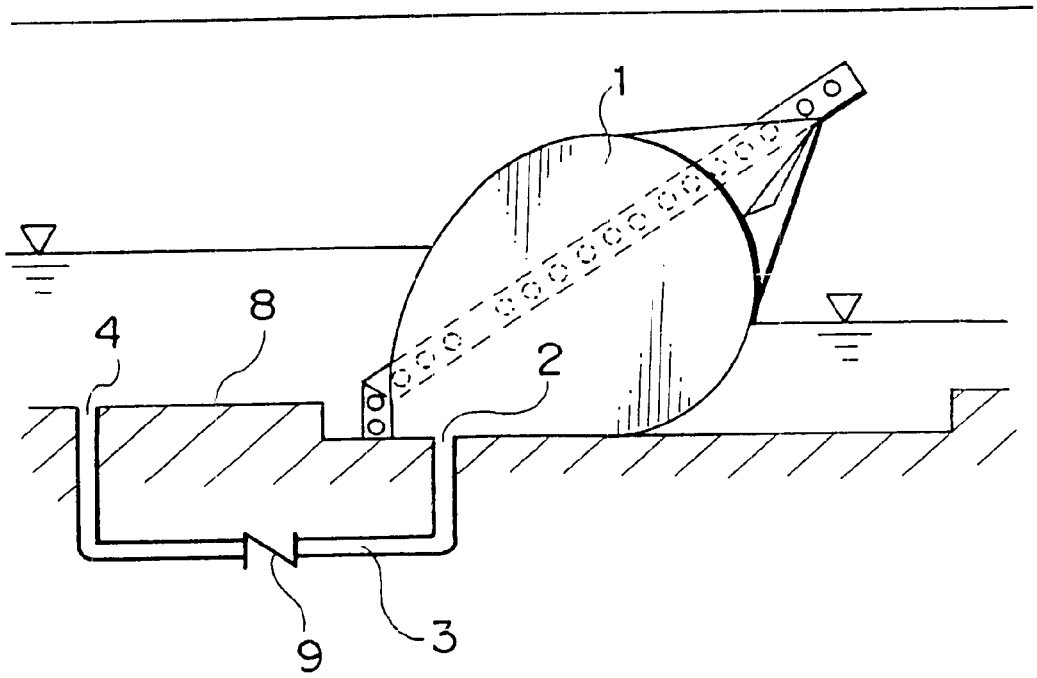
FIG. 3 is a cross sectional view which shows a flexible membrane dam using an internal pressure regulating system according to a second embodiment of the present invention.
Figure 4A:
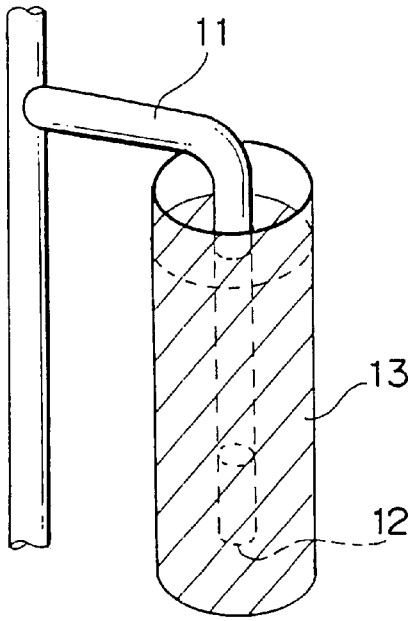
FIG.4A PRIOR ART
FIGS. 4A and 4B are diagrams showing conventional internal pressure regulating systems.
Figure 4B:
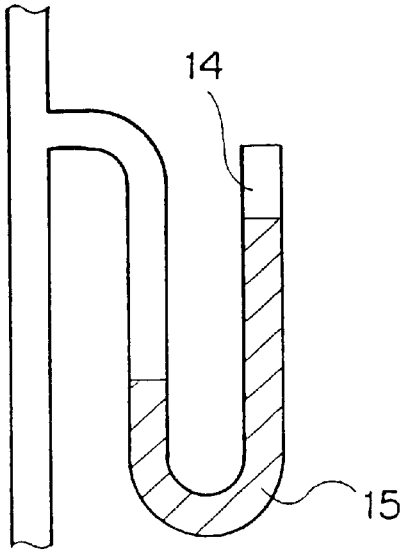
FIG.4B PRIOR ART

FIG. 3 is a cross sectional view showing a flexible membrane dam according to a second embodiment of the present invention. In the second embodiment, the exhaust opening 2 is formed on a lower surface of the flexible bag body 1 and the pipe body 3 extends in the ground with an open end thereof being located in a water bottom portion. According to the second embodiment, drain within the flexible bag body 1 can be discharged simultaneously. The pipe body 3 includes a non-return valve 9 which prevents water from counter-flowing into the bag body 1.

What is claimed is:

1. An internal pressure regulating system for a flexible bag body, in which gas within the flexible bag body is discharged when the flexible bag body used for a flexible membrane dam is excessively pressurized, said system comprising:

a flexible bag body which can be inflated with a gas for damming a body of water into upstream and downstream regions; and a pipe body having opposite first and second ends, wherein the bag body includes an exhaust opening for exhausting the gas, said first end of the pipe body is connected to the exhaust opening in the bag body, and said second end of the pipe body is introduced into the upstream region of the body of water and is positioned at a level equal to or above a reference surface, and wherein an internal pressure of the bag body reduces to be equal to atmospheric pressure when the water level at the upstream region decreases to the reference surface at which the flexible membrane dam is installed such that the bag body can be automatically collapsed, which directly results from a level that the second end of the pipe body is submerged.

2. The internal pressure regulating system of claim 1, further comprising at least one non-return valve disposed in the pipe body.

3. The internal pressure regulating system of claim 2, wherein said second end of the pipe body is submerged below the water surface.

4. The internal pressure regulating system of claim 3, wherein said second end of the pipe body is submerged to the level that is at least equal to the reference surface according to where the flexible bag body is installed.

5. The internal pressure regulating system of claim 4, wherein the flexible bag body includes an air supply opening from which inflation gas from an air supplying device is introduced to the bag body, and the exhaust opening is at a position separated from the air supply opening, at an upper side of a level of drain within the bag body.

6. The internal pressure regulating system of claim 5, wherein the flexible bag body includes first and second ends, and the exhaust opening is formed at the first end of the bag body, and the air supply opening is formed at the second end of the bag body.

7. The internal pressure regulating system of claim 3, wherein the flexible bag body includes an air supply opening from which inflation gas from an air supplying device is introduced to the bag body, and the exhaust opening is at a position separated from the air supply opening, at an upper side of a level of drain within the bag body.

8. The internal pressure regulating system of claim 7, wherein the flexible bag body includes first and second ends, and the exhaust opening is formed at the first end of the bag body, and the air supply opening is formed at the second end of the bag body.

9. The internal pressure regulating system of claim 1, wherein the pipe body is extended above the bag body to introduce said second end of the pipe body into the body of water from above the water surface, the second end of the pipe body being submerged below the water surface and facing the reference surface.

10. The internal pressure regulating system of claim 9, wherein said second end of the pipe body is submerged to the level that is at least equal to the reference surface according to where the flexible bag body is installed.

11. The internal pressure regulating system of claim 10, wherein the flexible bag body includes an air supply opening from which inflation gas from an air supplying device is introduced to the bag body, and the exhaust opening is at a position separated from the air supply opening, at an upper side of a level of drain within the bag body.

12. The internal pressure regulating system of claim 11, wherein the flexible bag body includes first and second ends, and the exhaust opening is formed at the first end of the bag body, and the air supply opening is formed at the second end of the bag body.

13. The internal pressure regulating system of claim 9, wherein the flexible bag body includes an air supply opening from which inflation gas from an air supplying device is introduced to the bag body, and the exhaust opening is at a position separated from the air supply opening, at an upper side of a level of drain within the bag body.

14. The internal pressure regulating system of claim 13, wherein the flexible bag body includes first and second ends, and the exhaust opening is formed at the first end of the bag body, and the air supply opening is formed at the second end of the bag body.

15. A flexible membrane dam for installation on a surface below a body of water, the dam comprising:

(a) an inflatable bag body, which when inflated with a gas, dams the body of water into upstream and downstream regions, the bag body including an exhaust opening for exhausting the gas; and (b) an internal pressure regulating system for said bag body, the system including a pipe body having opposite first and second ends, with said first end connected to the exhaust opening in the bag body, and said second end introduced into the upstream region of the body of water and is positioned at a level equal to or above a reference surface, wherein an internal pressure of the bag body reduces to be equal to atmospheric pressure when the water level at the upstream region decreases to the reference surface at which the flexible membrane dam is installed such that the bag body can be automatically collapsed, which directly results from a level that the second end of the pipe body is submerged.

16. The flexible membrane dam of claim 15, further comprising at least one non-return valve disposed in the pipe body.

17. The flexible membrane dam of claim 15, wherein the pipe body is extended above the bag body to introduce said second end of the pipe body into the body of water from above the water surface, the second end of the pipe body being submerged below the water surface and facing the reference surface.

18. The flexible membrane dam of claim 17, wherein said second end of the pipe body is submerged to the level that is at least equal to the reference surface according to where the flexible membrane dam is installed.

19. The flexible membrane dam of claim 17, further comprising an air supplying device, wherein the bag body includes an air supply opening connected to the air supplying device, for introducing gas for inflation into the bag body, and the exhaust opening is at a position separated from the air supply opening, at an upper side of a level of drain within the bag body.

20. The flexible membrane dam of claim 19, wherein said second end of the pipe body is submerged to the level that is at least equal to the reference surface according to where the flexible membrane dam is installed.

21. A method for regulating air pressure in a flexible membrane dam installed in a body of water, and having a bag body which when inflated, dams the body of water into upstream and downstream regions, wherein the bag body includes an exhaust opening for relieving pressure, the method comprising the steps of:

(a) providing a fluid conduit having opposite first and second ends, and connecting the first end of the fluid conduit to the exhaust opening of the bag body;

(b) introducing the second end of the fluid conduit into the water in the upstream region;

(c) installing the flexible membrane dam to a reference surface; and (d) reducing an internal pressure of the bag body to be equal to atmospheric pressure when the water level at the upstream region decreases to the reference surface at which the flexible membrane dam is installed such that the bag body can be automatically collapsed, which directly results from a level that the second end of the fluid conduit is submerged.

22. The method of claim 21, further comprising the step of continuously introducing inflation gas into the bag body.

23. The method of claim 21, further comprising the step of intermittently introducing inflation gas into the air bag body.

24. The method of claim 21, wherein the step of introducing the second end of the fluid conduit into the water in the upstream region includes maintaining said second end at a level equal to or above the reference surface according to where the flexible membrane dam is installed.

25. The method of claim 21, further comprising the step of preventing water from entering the bag body through the fluid conduit by using a one-way valve.

26. A method for regulating air pressure in a flexible bag body which can be inflated with a gas for damming a body of water into upstream and downstream regions, in which gas within the flexible bag body is discharged when the flexible bag body used for a flexible membrane dam is excessively pressurized, the bag body including an exhaust opening for exhausting the gas, the method comprising:

providing a pipe body having opposite first and second ends, and connecting said first end of the pipe body to the exhaust opening in the bag body;

introducing said second end of the pipe body into the upstream region of the body of water and positioning said second end of the pipe body at a level equal to or above a reference surface; and reducing an internal pressure of the bag body to be equal to atmospheric pressure when the water level at the upstream region decreases to the reference surface at which the bag body is installed such that the bag body can be automatically collapsed, which directly results from a level that the second end of the pipe body is submerged.

* * * * *